US005813886A

United States Patent [19]

Shomura

[11] Patent Number: 5,813,886

[45] Date of Patent: Sep. 29, 1998

[54] STRUCTURE FOR MOUNTING CONTROL SENSOR IN OUTBOARD MOTOR ENGINE

[75] Inventor: Nobuyuki Shomura, Hamamatsu, Japan

[73] Assignee: Suzuki Kabushiki Kaisha, Hamamatsu, Japan

[21] Appl. No.: 792,573

[22] Filed: Jan. 30, 1997

[30] Foreign Application Priority Data

Jan. 31, 1996 [JP] Japan ..... 8-015778

[51] Int. Cl.[6] ..... B63H 21/22

[52] U.S. Cl. ..... 440/1; 440/52; 440/84; 440/900; 123/196.5; 123/516; 123/685

[58] Field of Search ..... 440/1, 52, 77, 440/84, 113, 900; 123/196 S, 481, 497, 516, 685

[56] References Cited

U.S. PATENT DOCUMENTS 4,632,662 12/1986 Handa ..... 440/52

5,115,784 5/1992 Mito et al. ..... 123/516

5,522,370 6/1996 Katoh et al. ..... 123/685

*Primary Examiner*—Jesus D. Sotelo

*Attorney, Agent, or Firm*—Finnegan, Henderson, Farabow, Garrett & Dunner, L.L.P.

[57] ABSTRACT

A structure for mounting control sensors in an engine of an outboard motor permits a reduced number of components for attaching control sensors, a higher degree of freedom for laying out the parts constituting the engine, efficient wiring, further improved vibration insulating properties, and use of a throttle body employed for an engine of other equipment than the outboard motor. A discrete sensor mounting holder, as a single unit, which is composed of a vibration-proof member and which holds an intake air temperature detecting sensor and an atmospheric pressure detecting sensor, respectively, is fixed to an engine of the outboard motor, the engine being provided with a fuel injecting unit and the intake air temperature detecting sensor and the atmospheric pressure detecting sensor for controlling the fuel injecting unit.

8 Claims, 16 Drawing Sheets

TEMPERATURE CHARACTERISTIC OF PRESSURE DETECTION TOLERANCE

STRUCTURE FOR MOUNTING CONTROL SENSOR IN OUTBOARD MOTOR ENGINE

BACKGROUND OF THE INVENTION

The present invention relates to a structure for mounting a control sensor in an engine of an outboard motor.

Unlike motorcycles, four-wheel motorcars, or the like, an outboard motor is not generally provided with frames or bodies, and therefore, in an engine of the outboard motor provided with a fuel injecting unit, various control sensors for controlling fuel injection, including an atmospheric pressure detecting sensor or an intake pressure detecting sensor and an intake air temperature detecting sensor, are directly mounted on the engine. These control sensors employ semiconductor devices or electronic devices which have been developed mainly for four-wheel motorcars, which do not have high resistance to vibration. For this reason, when mounting such control sensors on an engine which vibrates, a vibration-proof structure is used to ensure resistance to vibration that satisfies predetermined requirements.

A conventional structure for mounting control sensors, namely, an intake air temperature detecting sensor and an atmospheric pressure detecting sensor will be first described hereunder with reference to FIG. 13 through FIG. 19.

Referring first to FIG. 13 through FIG. 16, the structure for mounting the intake air temperature detecting sensor will be described. The mounting structure shown in FIG. 13 through FIG. 16 illustrates an example in which an intake air temperature detecting sensor 100 is installed on a throttle body 101 which has an approximately cylindrical shape and which has a throttle valve 102 for controlling the amount of air to be taken into an engine. Provided on the top portion of the throttle body 101 is a throttle sensor 103 for detecting the angle of rotation of a rotation shaft 102*a* of the throttle valve 102. The intake air temperature detecting sensor 100 is mounted on the top portion of the throttle body 101 in the vicinity of the throttle sensor 103. The circumferential wall of an upstream opening 101*a* of the throttle body 101 is a boss 101*b* for mounting the sensor, the boss 101*b* projecting upward, and the intake air temperature detecting sensor 100 is fixed to the boss 101*b* through a mounting hole 101*c* provided therein by a mounting plate 105 and a screw 106 via a vibration-proof rubber member 104. As shown in FIG. 15, the intake air temperature detecting sensor 100 detects the temperature of air taken into the engine in a condition where the bottom end thereof is in the throttle body 101 and provided with the vibration-proof rubber member 104 for protection against vibration.

The structure for mounting the atmospheric pressure detecting sensor will now be described with reference to FIG. 17 through FIG. 19. An atmospheric pressure detecting sensor 107 is mounted in a different position from that of the intake air temperature detecting sensor 100 in the engine. More specifically, the atmospheric pressure detecting sensor 107 is installed on a boss 108 provided on an engine constituent component other than the throttle body 101 via an approximately L-shaped mounting plate 109. The mounting plate 109 is composed of a horizontal plate member 109*a* combined with a vertical plate member 109*b* to be formed into a nearly L shape, the atmospheric pressure detecting sensor 107 being fixed to the bottom surface of the horizontal plate member 109*a* with screws 110. The vertical plate member 109*b* of the mounting plate 109 is fixed to the boss 108 with bolts 116 via pairs of spacers 112, vibration-proof rubber members 113, and washers 115, so that the vibration-proof rubber members 113 absorb the vibration of the engine to restrain the vibration of the atmospheric pressure detecting sensor 107.

Thus, in the conventional structure for mounting control sensors, the respective control sensors, namely, the intake air temperature detecting sensor 100 and the atmospheric pressure detecting sensor 107, are separately installed, requiring many mounting components and vibration-proof rubber members for each control sensor, requiring the addition of the number of assembling working and/or cost due to many components involved. In addition, each control sensor requires a mounting space, leading to a disadvantage of restricted layout of the parts composing the engine. Furthermore, the respective control sensors are disposed at different locations, resulting in another disadvantage of complicated wiring between the respective control sensors and an engine control unit.

Further, as in the case of the structure for mounting the intake air temperature detecting sensor 100, in order to install a control sensor on the throttle body 101, the boss 101*b* has to be formed on the throttle body 101, making it impossible to use the throttle body of other vehicle such as a four-wheel motorcar, interfering with standardizing the components.

In such a case as the structure for mounting the atmospheric pressure detecting sensor 107 where the vibration-proof rubber member 113 is mounted on the shank of the bolt 116, a problem is encountered in that the vibration-proof rubber member 113 fails to provide sufficient deformation relative especially to the vibration in the direction indicated by a letter X in FIG. 17. This problem would be solved by increasing the size of the vibration-proof rubber member 113. However, increasing the size thereof would require a larger mounting space, resulting in a further restricted layout of the engine components. Alternatively, the atmospheric pressure detecting sensor 107 may be mounted in such a manner that the vibration in the direction X is controlled. However, this would also affect the layout of the engine components. Hence, there has been strong demand for providing a vibration-proof structure which provides better vibration insulating properties.

SUMMARY OF THE INVENTION

A primary object of the present invention is to substantially eliminate defects or drawbacks encountered in the prior art and to provide a structure for mounting control sensors in an engine of an outboard motor, capable of realizing a reduced number of components for mounting control sensors so as to reduce the assembling working and cost, enabling more freedom in the layout of the components constituting the engine and higher wiring efficiency, achieving an improved vibration-proof performance, and enabling the use of a throttle body employed in an engine for equipment other than the outboard motor.

This and other objects can be achieved according to the present invention by providing a structure for mounting a control means in an engine of an outboard motor which is provided with a fuel injecting unit and a plurality of control sensors including at least an intake air temperature detecting sensor and a pressure detecting sensor for controlling the fuel injecting unit, wherein a discrete sensor mounting holder, as a single holding means, for holding the plurality of control sensors is fixed to the engine, the discrete sensor mounting holder being formed of a vibration-proof member.

In a preferred embodiment, the engine is further provided with a throttle means having substantially a cylindrical body and having an opening formed on an upstream side of an air flow and the sensor mounting holder is fixed above the opening of the throttle means body. The sensor mounting holder has substantially a box-shaped outer appearance provided with a plurality of holding sections in which the plurality of control sensors are accommodated and held, respectively, and a mounting piece formed with a fastening means insertion hole. The vibration-proof member forming the sensor mounting holder is an elastic member such as rubber having heat insulation performance and durability.

The engine may be a multicylinder, two-stroke cycle engine equipped with a crankcase which rotatably supports a crankshaft, a surge tank which is disposed at a front portion of the crankcase and which communicates with an interior of the crankcase, and a throttle means having substantially a cylindrical body which is disposed on a right or left side of the surge tank to communicate with the surge tank and which has an upstream opening directed sideways, and the sensor mounting holder is located above the upstream opening of the throttle body and fixed on a side wall of the surge tank. The side wall of the surge tank is formed with a boss to which the mounting piece is attached.

According to the structures and arrangements of the present invention described above, since the plurality of control sensors are held respectively by the discrete sensor mounting holder, the number of components can be considerably reduced in comparison with the conventional structure which requires the mounting components for each control sensor. This enables reduced assembling working and cost.

Moreover, since the plurality of control sensors can be mounted on the single sensor mounting holder, the plurality of control sensors can be concentrated in one location, preventing the plurality of control sensors from being separated in arrangement in the engine. This permits greater freedom of the layout of the parts constituting the engine, and the control sensors which are concentrated in one location also permit higher efficiency for wiring the respective control sensors.

Furthermore, the sensor mounting holder can be made to successfully cope with vibrations in every direction by securing a certain size of the sensor mounting holder itself, thus making it possible to achieve higher vibration-proof performance than that available with the convention structure.

In addition, the sensor mounting holder is fixed above the upstream opening of the throttle body with respect to the air flow, the plurality of control sensors are disposed at the end portion of an intake path in the outboard motor. Hence, the plurality of control sensors will lie in the air, from which water contents such as water droplets have been separated sufficiently by collision with the engine components in the course of passing through the intake path, thus making it possible to prevent water or the like from getting into the control sensors.

Furthermore, in another preferred embodiment, since the sensor mounting holder holding the plurality of control sensors is fixed to the surge tank, it is not necessary to provide the throttle body with any special machining. Thus, a throttle body used for the engine of an equipment other than the outboard motor can also be employed. Further, since the sensor mounting holder is fixed on the side wall of the surge tank, the control sensors can be installed on a stagnation-free intake path, making it possible to operate the control sensors in an environment of ordinary or nearly ordinary temperatures.

BRIEF DESCRIPTION OF THE DRAWINGS

The present invention will be more clearly understood from the following descriptions made with reference to the accompanying drawings, in which:

FIG. 11 is a partial sectional view of an intake air temperature detecting sensor according to the embodiment, in which

DESCRIPTION OF THE PREFERRED EMBODIMENT

Figure 1:
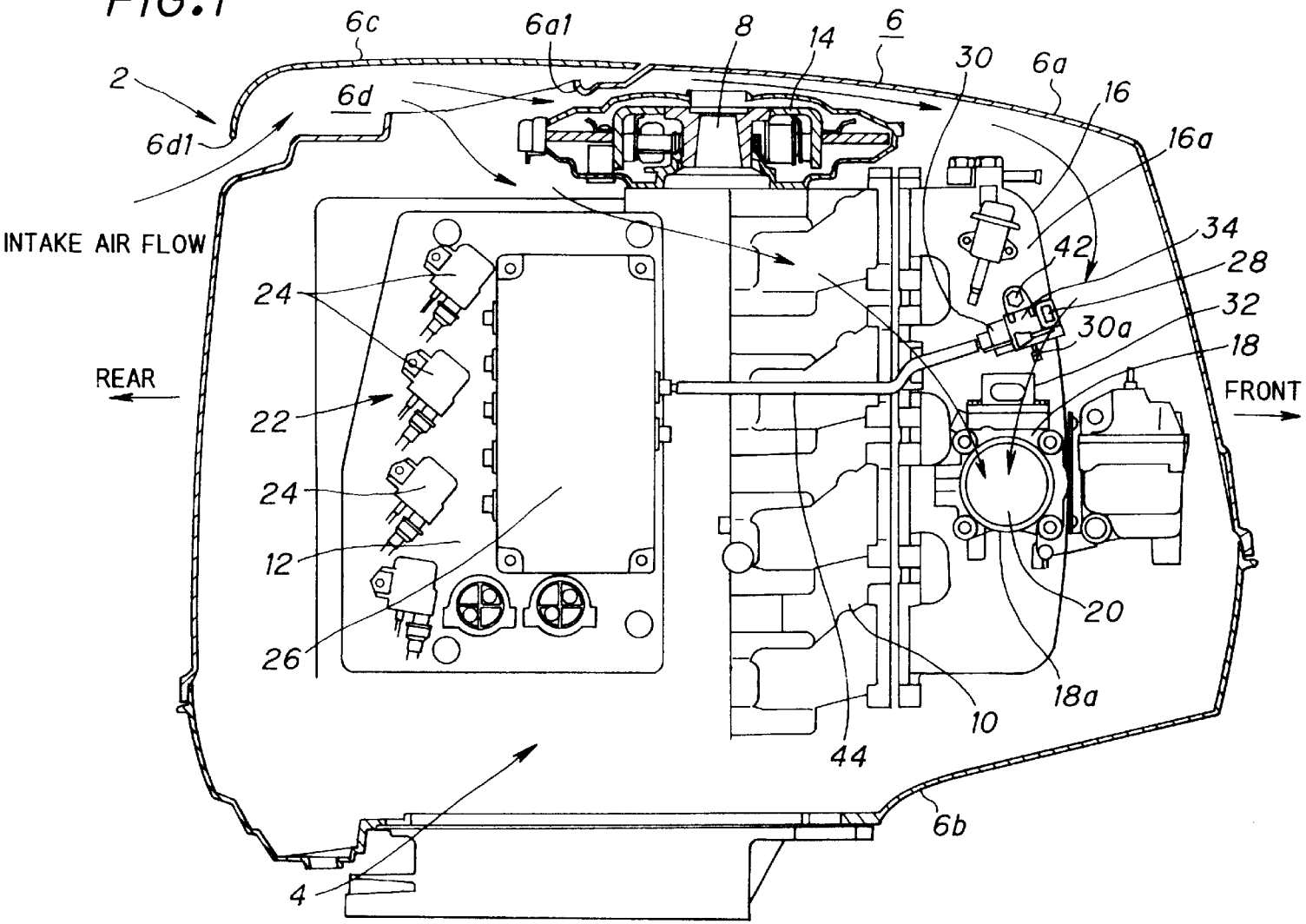
FIG. 1 is a side view, partially in section, of an engine according to one embodiment of the present invention.
Figure 2:
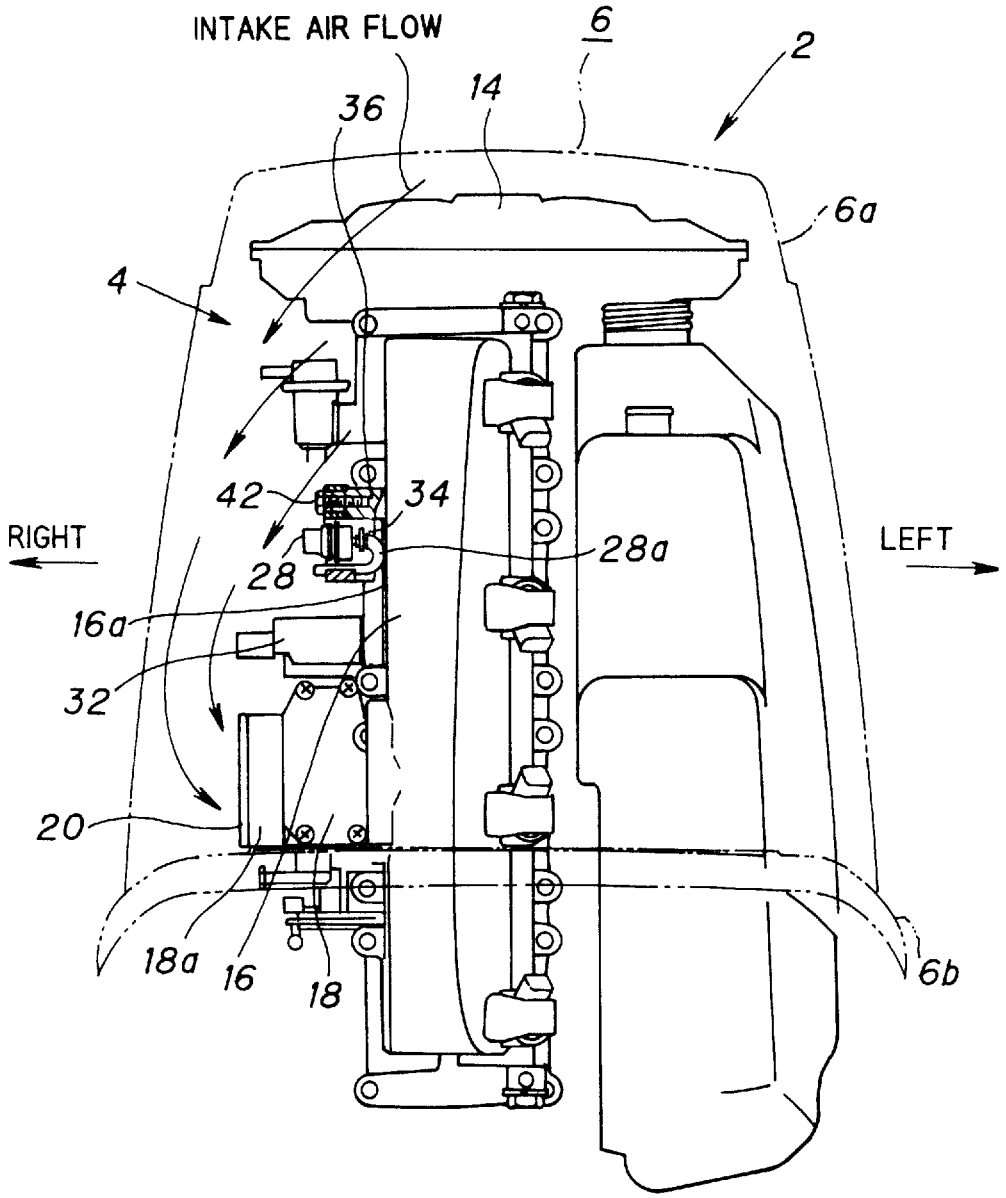
FIG. 2 is a front view of the engine according to the embodiment.

A preferred one embodiment of the present invention will be described hereunder with reference to the accompanying drawings. In this embodiment, the right and the left sides will mean the larboard side and the starboard side, respectively, of an outboard motor, and the front and the rear sides will mean the direction of a ship moving forward and backward, respectively. As shown in FIG. 1 and FIG. 2, an outboard motor 2 in accordance with the embodiment is provided with a multicylinder two-stroke cycle engine 4 and an engine case 6 housing the engine 4, which is fixed on a stern board of a hull (not shown). The engine case 6 is primarily composed of an upper cover 6*a* which covers the engine 4 from above and a lower cover 6*b* which has an upper edge fitting in the lower edge of the upper cover 6*a*. Formed at the rear portion of the top wall of the upper cover 6*a* is an air inlet 6*a*1 which opens nearly upward as shown in FIG. 1, and the air inlet 6*a*1 is covered from the above by a cover 6*c* provided on the upper cover 6*a*. The cover 6*c* and the rear portion of the top wall of the upper cover 6*a* form an air introducing chamber 6*d*, which has an air introducing inlet 6*d*1 at the rear end thereof, around the air inlet 6*a*1.

As shown in FIG. 1 and FIG. 2, the engine 4 is equipped with a crankcase 10 which rotatably supports a crankshaft 8, a cylinder 12 on which a piston (not shown) slides, the piston moving up and down as the crankshaft 8 rotates, and a magnet 14 disposed on the upper end portion of the crankshaft 8 which juts upward out of the crankcase 10. The engine 4 is further equipped with a longitudinal surge tank 16 which is set vertically at the front of the crankcase 10 and which communicates with the interior of the crankcase 10. Provided on a side wall 16*a* on the right or left (the right in this embodiment) of the surge tank 16 is an approximately cylindrical throttle body 18 which incorporates a throttle valve (not shown) for regulating the amount of air to be taken into the surge tank 16.

As illustrated in FIG. 1 and FIG. 2, the throttle body 18 is disposed such that the central axis thereof is laterally positioned slightly below the vertical center in the side wall 16*a* of the surge tank 16, and an upstream opening 18*a* thereof provided with a filter 20 for filtering air is directed sideways (directed to the right in this embodiment). As shown in FIG. 1 and FIG. 2, the air which has been introduced into the air introducing chamber 6*d* through the air introducing inlet 6*d*1 passes by the vicinity of the magnet 14, then moves down along the outer surface of the crankcase 10 and the surge tank 16 in the engine case 6, and it is filtered through the filter 20 before being admitted into the throttle body 18 through the upstream opening 18*a*.

A fuel injecting unit provided on the engine 4 will now be described. As shown in FIG. 1, the engine 4 is equipped with a fuel injecting unit 22 having a plurality of injectors 24, the number of the injectors 24 corresponding to the number of cylinders, various control sensors for controlling the amount of fuel to be injected from the respective injectors 24 of the fuel injecting unit 22, and an engine control unit 26 which decides and instructs an optimum valve opening time of each injector 24 by analyzing the information received from the respective control sensors. In this embodiment, an intake air temperature detecting sensor 28, an atmospheric pressure detecting sensor (an example representing the pressure detecting sensor) 30, and a throttle sensor 32 are provided at appropriate locations of the engine 4. The throttle sensor 32 is disposed on the top of the throttle body 18 to detect the opening of the throttle valve.

The intake air temperature detecting sensor 28 and the atmospheric pressure detecting sensor 30 are held by a discrete, i.e. single, sensor mounting holder 34 composed of a vibration-proof member, the sensor mounting holder 34 being fixed to the engine 4. The structure for attaching a control sensor using the sensor mounting holder 34 will be described in detail hereunder.

Figure 3:
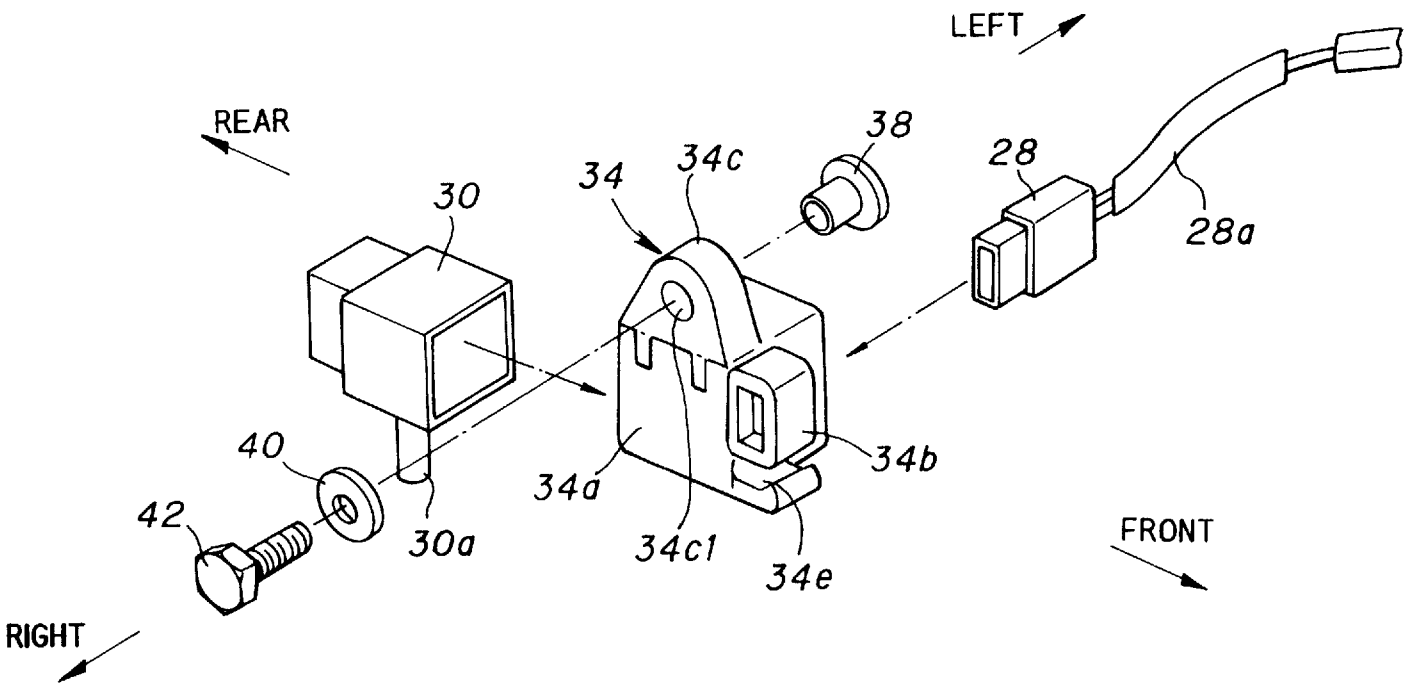
FIG. 3 is an exploded perspective view of a control sensor mounting structure according to the embodiment.
Figure 4:
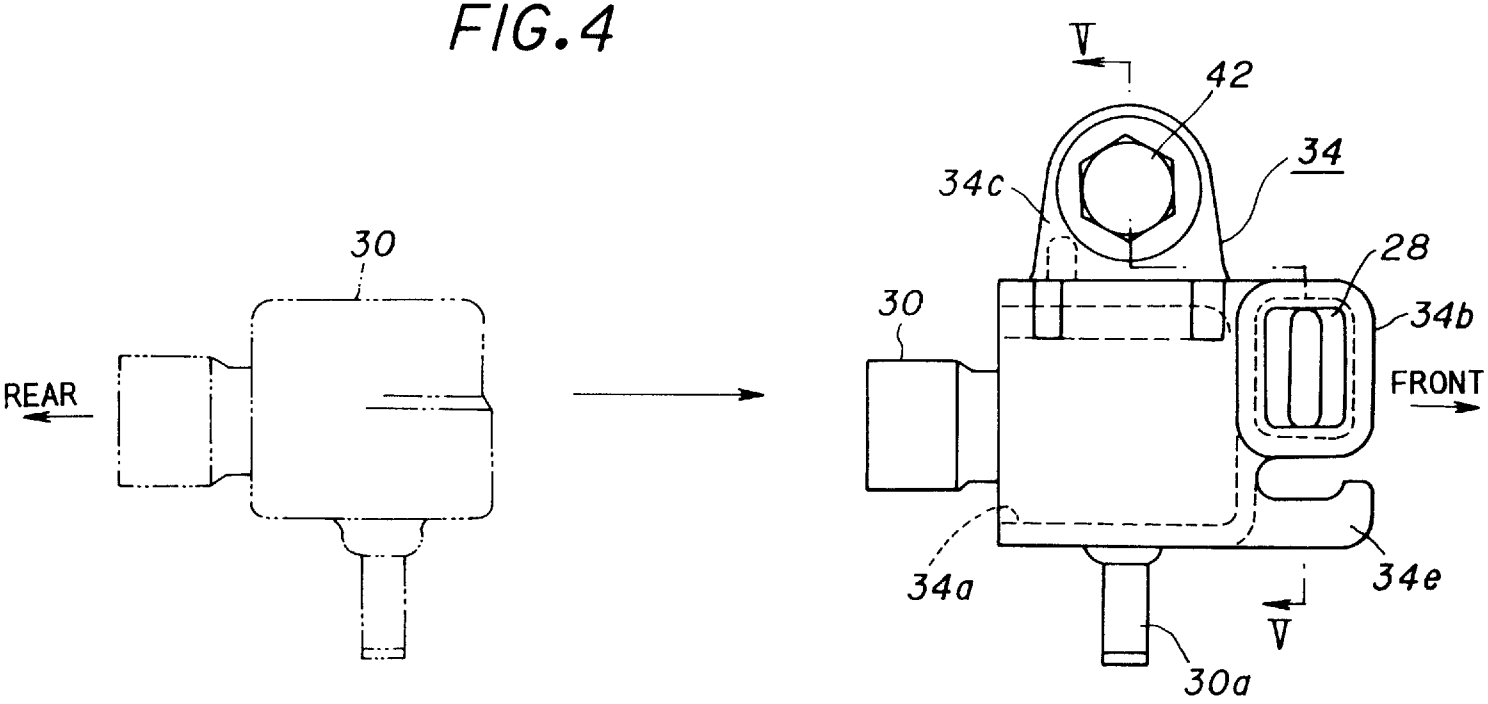
FIG. 4 is a side view of the control sensor mounting structure according to the embodiment.
Figure 5:
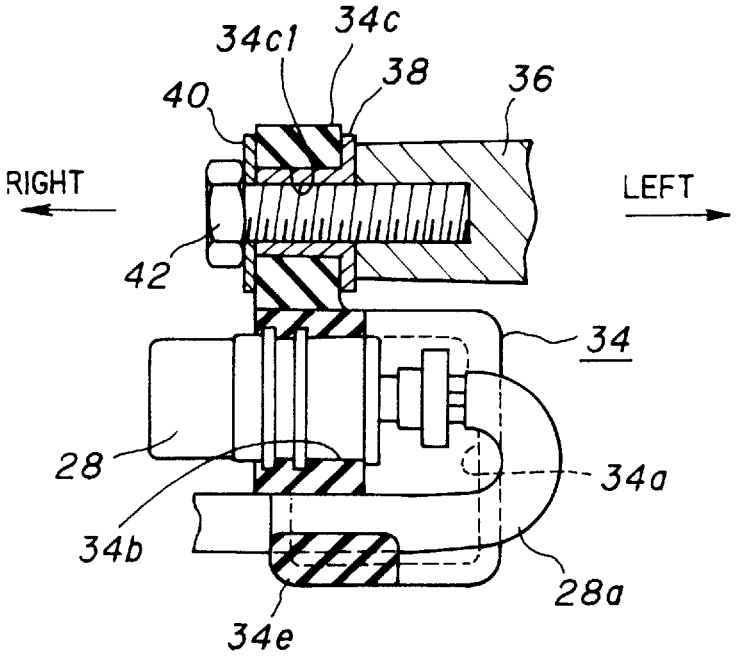
FIG. 5 is a sectional view taken on V—V shown in FIG. 4.
Figure 6:
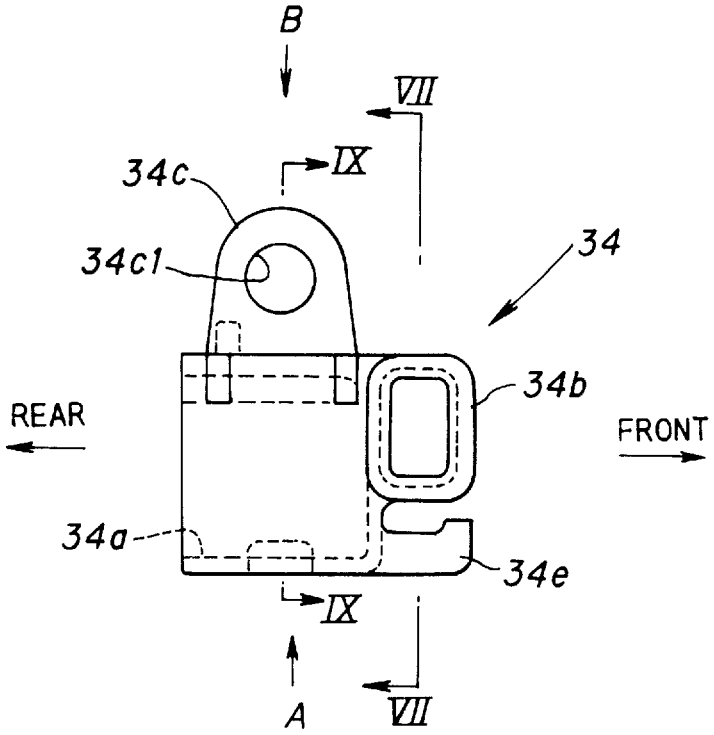
FIG. 6 is a side view of a sensor mounting holder according to the embodiment.
Figure 7:
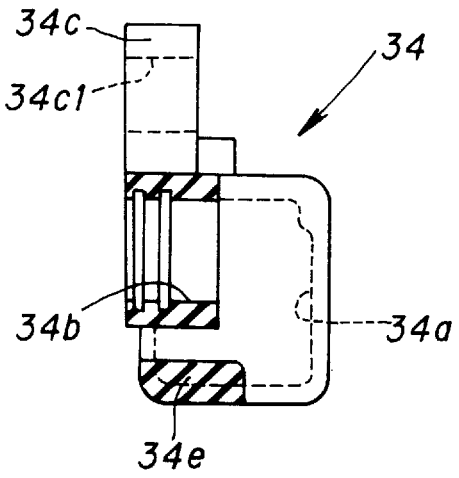
FIG. 7 is a sectional view taken on VII—VII shown in FIG. 6.

As illustrated in FIG. 3 to FIG. 5, the sensor mounting holder 34 is a discrete component which is an approximately box-shaped and it is comprised mainly of a first holding section 34*a* for holding the atmospheric pressure detecting sensor 30, a second holding section 34*b* for holding the intake air temperature detecting sensor 28, and a mounting tab 34*c* which has a bolt inserting hole 34*c*1. Preferably, an elastic member made of rubber or the like which exhibits good thermal insulating properties and good durability should be employed as the vibration-proof material for the sensor mounting holder 34.

Figure 8:
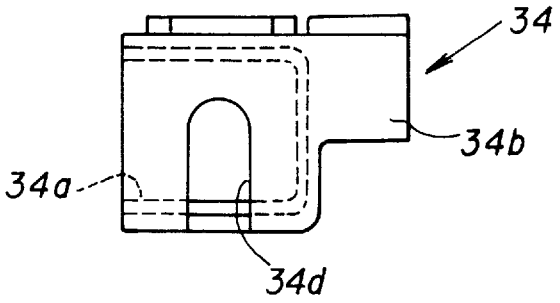
FIG. 8 is a fragmentary view observed from a direction of arrow A shown in FIG. 6.
Figure 9:
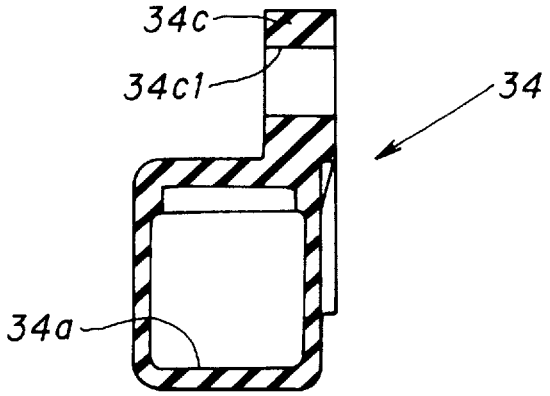
FIG. 9 is a sectional view taken on IX—IX shown in FIG. 6.
Figure 10:
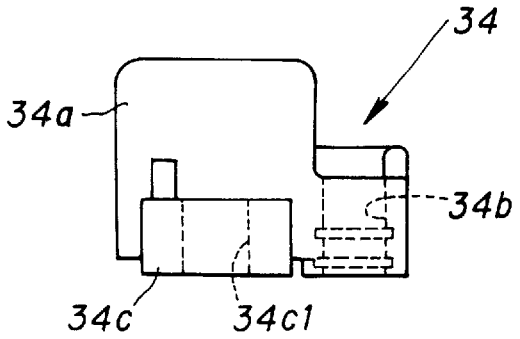
FIG. 10 is a fragmentary view observed from a direction of arrow B shown in FIG. 6.

As shown in FIG. 6 to FIG. 10, the first holding section 34*a* is an empty, almost cubic box with only the rear side thereof, i.e. the side facing the rear of the outboard motor, open, and it has an interior which is shaped to match the external shape of the atmospheric pressure detecting sensor 30. Formed in the bottom wall of the first holding section 34*a* is a slot 34*d* in which a detecting section 30*a* to be discussed hereinlater of the atmospheric pressure detecting sensor 30 is fitted as shown in FIG. 8.

As illustrated in FIG. 3, the second holding section 34*b* is formed integrally with the front wall of the first holding section 34*a* and it is almost cylindrically shaped with a nearly rectangular section hollowed laterally. The internal shape of the second holding section 34*b* is matched with the external shape of the intake air temperature detecting sensor 28. Formed integrally in the vicinity of the bottom of the second holding section 34*b* is a lead wire supporting section 34*e* so as to jut out forward from the bottom end of the front wall of the first holding section 34*a* as shown in FIG. 5. The mounting tab 34*c* is integrally formed such that it juts out upward from the top wall of the first holding section 34*a* as illustrated in FIG. 3, and the bolt inserting hole 34*c*1 penetrates laterally.

As illustrated in FIG. 3, the atmospheric pressure detecting sensor 30 has, on the bottom wall thereof, a detecting port 30*a* which projects downward, and it is inserted into the first holding section 34*a* from the rear opened side thereof with the detecting port 30*a* in the slot 34*d* (see FIG. 8). The intake air temperature detecting sensor 28 is inserted in the second holding section 34*b* from left to right as shown in FIG. 3. A lead wire 28*a* of the intake air temperature sensor 28 is bent back at the left of the second holding section 34*b*, then retained by the lead wire supporting section 34*e* as illustrated in FIG. 5.

Thus, as shown in FIG. 1 and FIG. 2, the sensor mounting holder 34 which holds both the atmospheric pressure detecting sensor 30 and the intake air temperature detecting sensor 28 is located above the upstream opening 18*a* of the throttle body 18 and fixed on the side wall 16*a* of the surge tank 16. A boss 36 for fixing the sensor mounting holder 34 projects from the side wall 16*a* of the surge tank 16 as illustrated in FIG. 2. To fix the sensor mounting holder 34 to the boss 36, a spacer 38 is inserted in the bolt inserting hole 34*c*1 of the mounting tab 34*c* and a bolt 42 with a washer 40 attached is inserted in the inner hole of the spacer 38, then the bolt 42 is screwed into the boss 36 as shown in FIG. 5.

According to the embodiment which has the configuration described above, the atmospheric pressure detecting sensor 30 and the intake air temperature detecting sensor 28 are respectively held by the first holding section 34*a* and the second holding section 34*b* of the discrete sensor mounting holder 34. Therefore, the number of components can be considerably reduced in comparison with the conventional structure which requires the mounting components for each control sensor. To be more specific, the two control sensors can be attached by using only the bolt 42, the spacer 38, and the washer 40, allowing the assembling working and cost to be reduced and also permitting reduction in the weight of the engine 4 and improved maintainability of control sensors.

Moreover, the single sensor mounting holder 34 can hold the two control sensors, namely, the atmospheric pressure detecting sensor 30 and the intake air temperature detecting sensor 28, and therefore, a plurality of control sensors can be concentrated in one location. This makes it possible to prevent the plurality of control sensors from being separated in location in the engine 4, permitting a higher degree of freedom of the layout of the parts composing the engine. Further, since the atmospheric pressure detecting sensor 30 and the intake air temperature detecting sensor 28 are concentrated at one place, the wiring of a harness 44 (see FIG. 1) between the atmospheric pressure detecting sensor 30 and the intake air temperature detecting sensor 28 and the engine control unit 26 can be made efficiently.

Figure 11A:
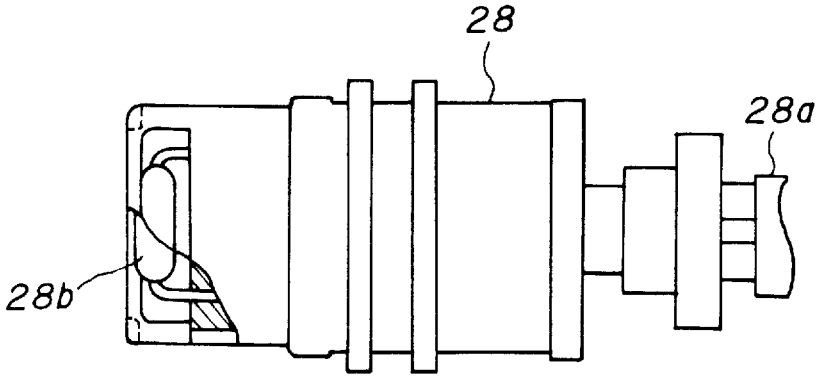
FIG. 11A illustrates a type with a non-exposed temperature detecting element and FIG. 11B illustrates a type with an exposed temperature detecting element.
Figure 11B:
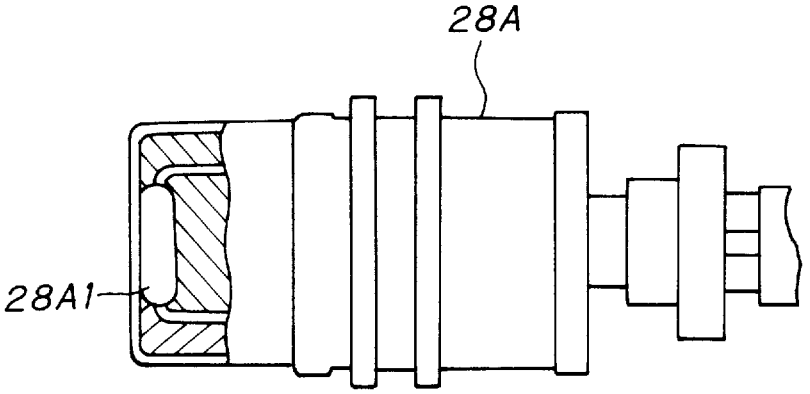

The sensor mounting holder 34 itself is sufficiently large, surrounds and holds the atmospheric pressure detecting sensor 30 and the intake air temperature detecting sensor 28. This enables the sensor mounting holder 34 to successfully cope with vibrations in a longitudinal direction, a lateral direction, or a vertical direction, permitting further improved vibration insulating properties. Hence, it becomes possible to employ the intake air temperature detecting sensor 28 which has an exposed temperature detecting element 28*b* such as a thermistor shown in FIG. 11A. More specifically, it has been difficult to apply the air temperature detecting sensor 28, which has such an exposed temperature detecting element, to the conventional control sensor mounting structure in comparison with another type in which a temperature detecting element 28*a*1 is separated from the outside, because it exhibits poor resistance to vibration although it is hardly susceptible to the conduction of heat of the engine 4 and exhibits good follow-up properties relative to temperature changes. This embodiment, however, provides good vibration insulating properties as described above, enabling this type of sensor to be successfully used with the outboard motor.

Figure 15:
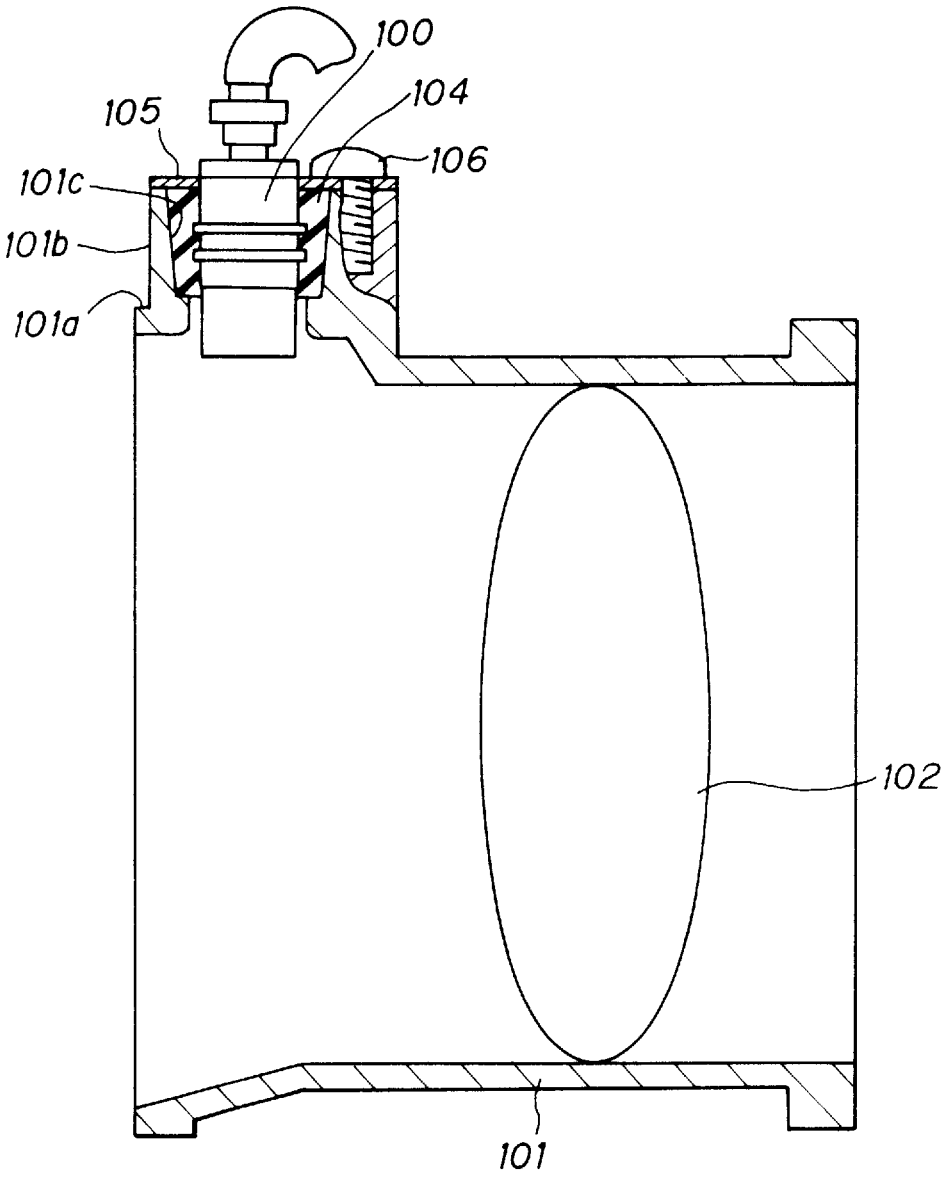
FIG. 15 PRIOR ART
FIG. 15 is a sectional view of the conventional throttle body to which the intake air temperature detecting sensor is attached.
Figure 16:
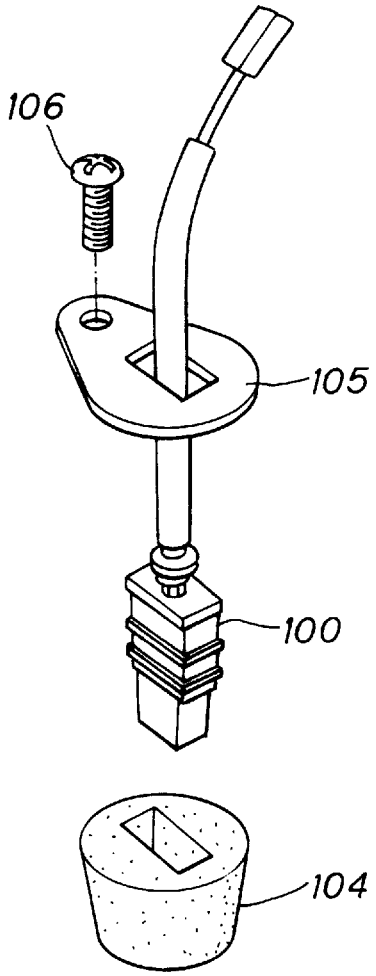
FIG. 16 PRIOR ART
FIG. 16 is an exploded perspective view of a conventional intake air temperature detecting sensor mounting structure.
Figure 17:
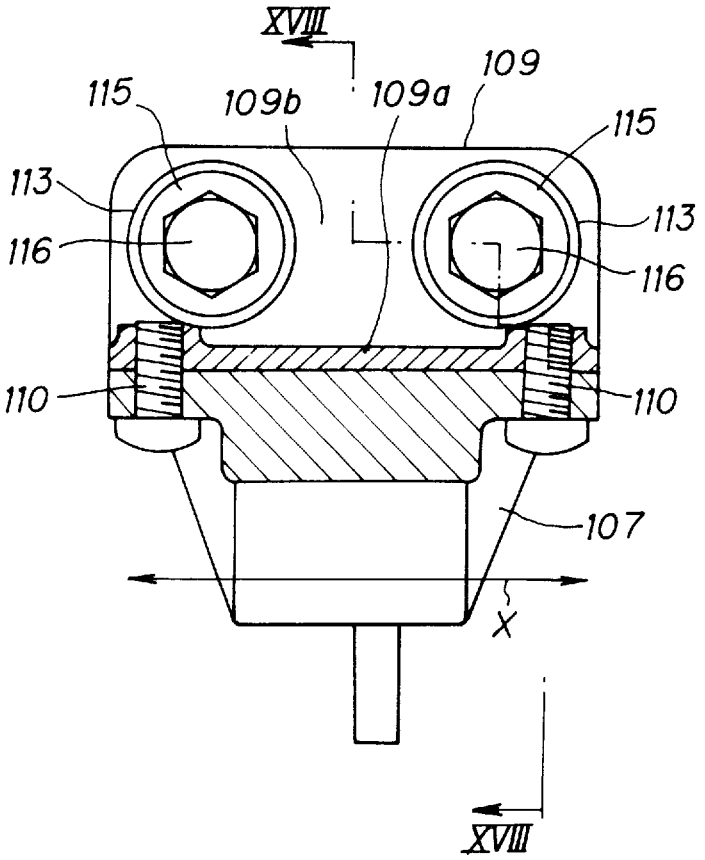
FIG.17 PRIOR ART
FIG. 17 is an assembly diagram illustrative of a conventional atmospheric pressure detecting sensor mounting structure.
Figure 18:
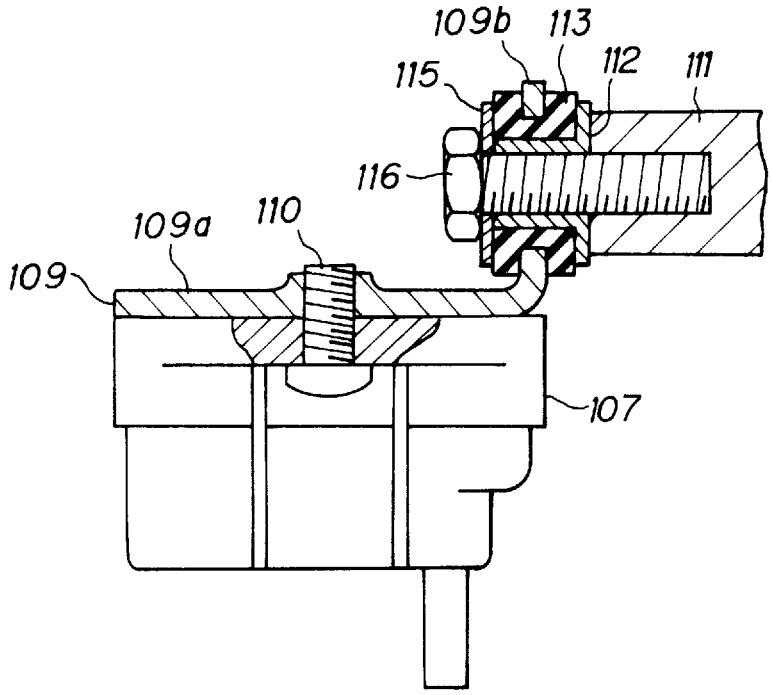
FIG. 18 PRIOR ART
FIG. 18 is a sectional view taken on XVIII—XVIII shown in FIG. 17.
Figure 19:
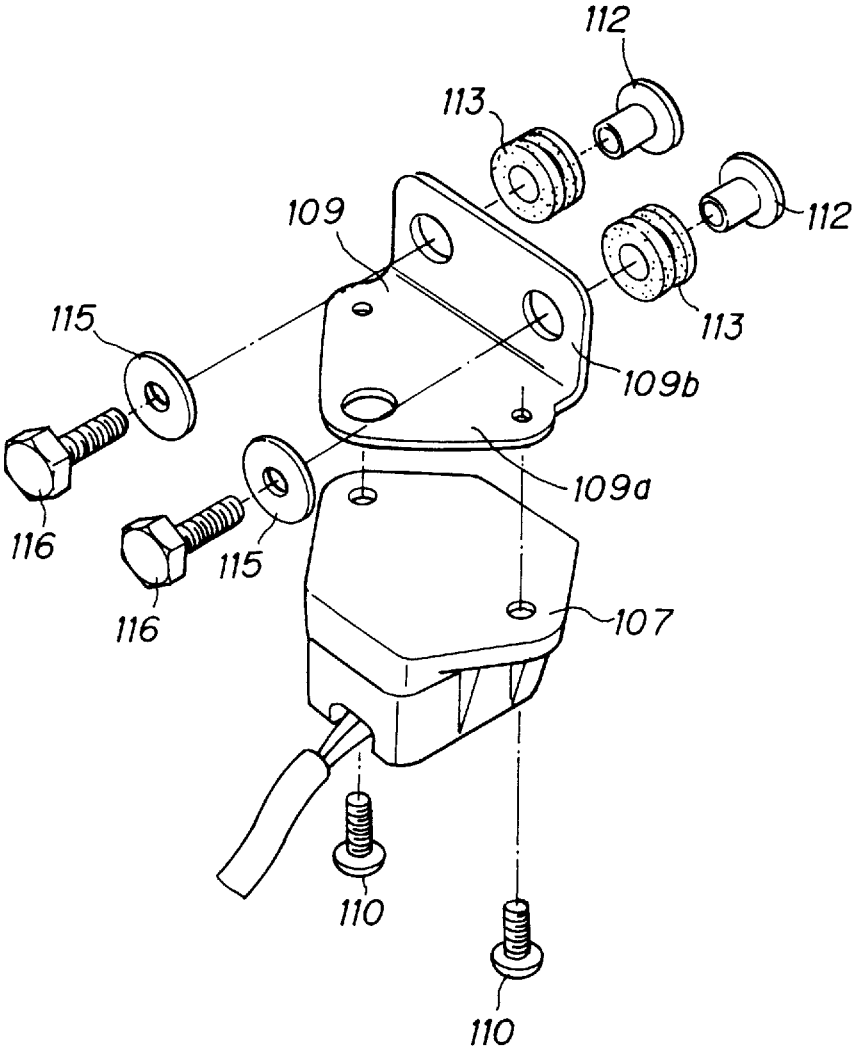
FIG.19 PRIOR ART
FIG. 19 is an exploded perspective view of the conventional atmospheric pressure detecting sensor mounting structure.

Further, the sensor mounting holder 34 itself is sufficiently large, but it has a small area of contact with the surge tank 16, thus restraining the transfer of heat from the cylinder 12 to the intake air temperature detecting sensor 28. This enables the intake air temperature to be detected accurately when, for example, restarting the engine 4, and makes it possible to calculate and inject an optimum injection amount required by the engine 4. In contrast to the present embodiment, in the conventional vibration-proof structure illustrated in FIG. 15, the vibration-proof rubber member 104 itself is small, but it has a large area of contact with the intake air temperature detecting sensor 100 and with the engine (throttle body 101). For this reason, when the engine is stopped immediately after it is run at high speed, the cooling function of the engine, i.e. the circulation of cooling water, stops and the heat generated by the combustion that takes place in the engine is transferred in the order of a cylinder, a crankcase, an intake manifold surge tank, and the throttle body 101, thus warming the intake air temperature detecting sensor 100, which leads to a problem in that, when the engine is restarted with the intake air temperature detecting sensor 100 warmed up, a higher temperature than the actual intake air temperature will be detected.

Furthermore, according to the embodiment of the present invention, since the sensor mounting holder 34 is fixed to the surge tank 16, there is no need to provide the throttle body 18 with special machining. Hence, the throttle body employed with an engine for other equipment than the outboard motor can be used for the engine of the outboard motor. At the same time, the sensor mounting holder 34 can be standardized even for engines of different displacements and for throttle bodies of different shapes.

Figure 12:
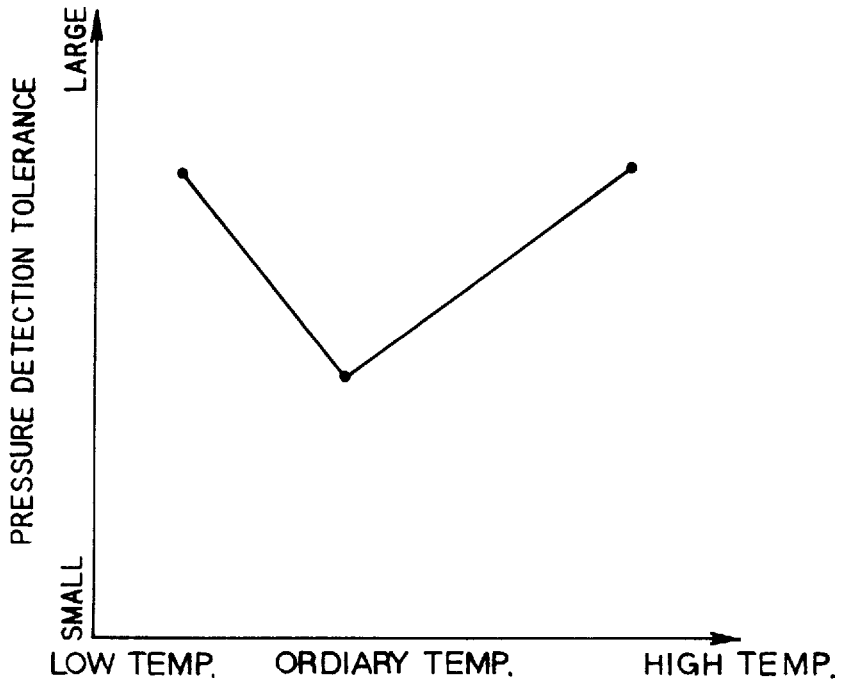
FIG. 12 is a graph illustrative of the temperature characteristic of an atmospheric pressure detecting sensor.
Figure 13:
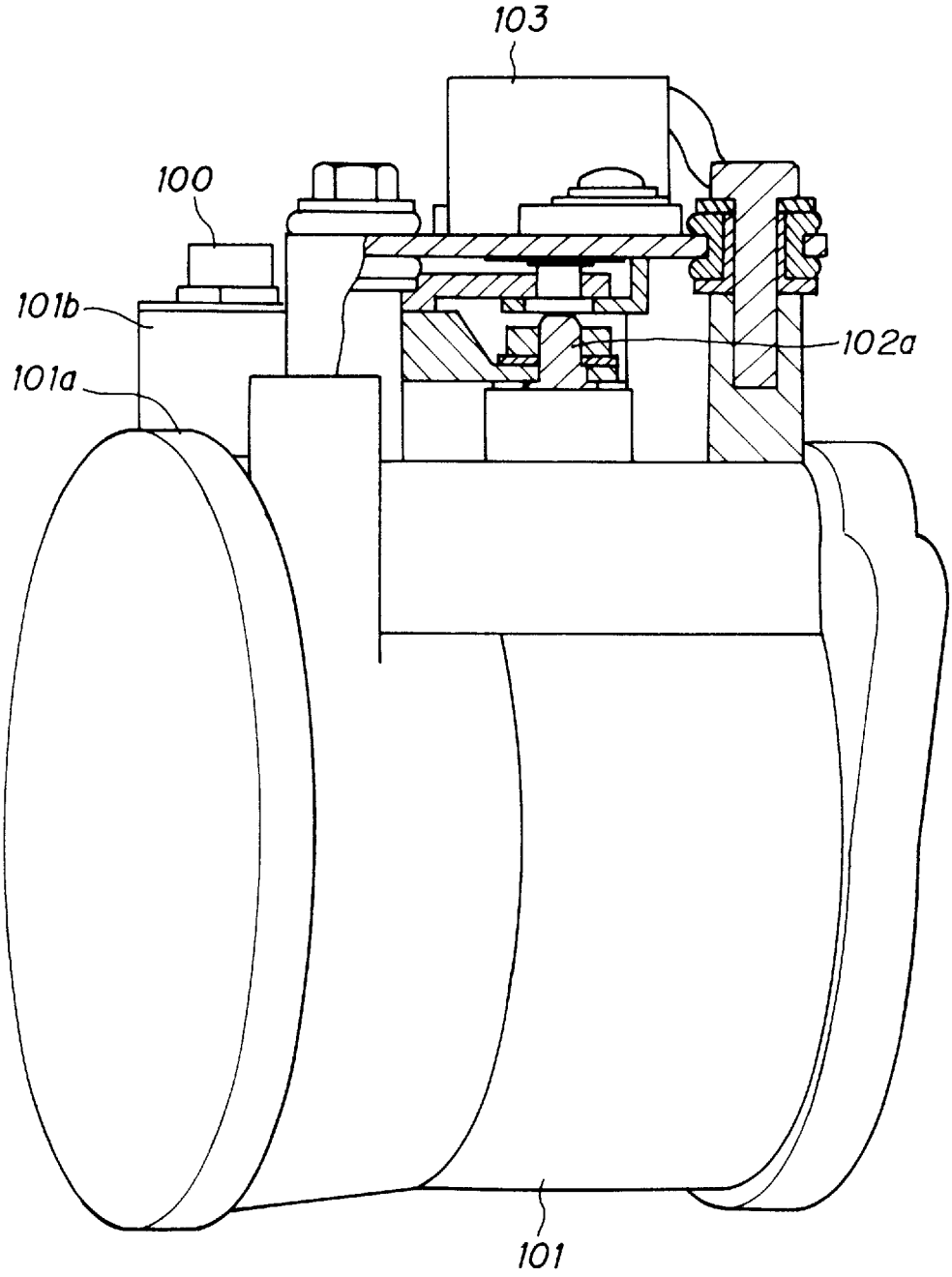
FIG. 13 PRIOR ART
FIG. 13 is a perspective view of a conventional throttle body to which an intake air temperature detecting sensor is attached.
Figure 14:
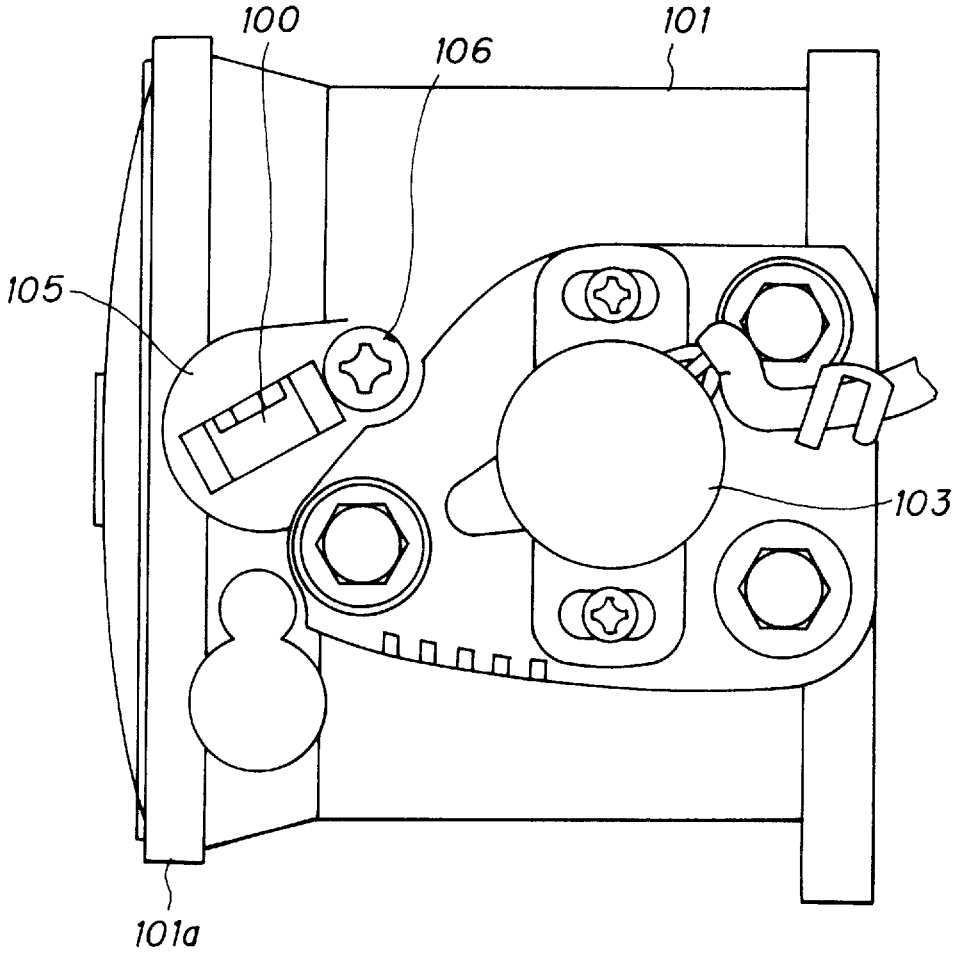
FIG.14 PRIOR ART
FIG. 14 is a top plan view of the conventional throttle body to which the intake air temperature detecting sensor is attached.

In addition, since the sensor mounting holder 34 is fixed to the side wall 16*a* of the surge tank 16, the atmospheric pressure detecting sensor 30 is positioned on a stagnation-free intake air path. This enables the atmospheric pressure detecting sensor 30 to be operated in an environment of ordinary or nearly ordinary temperatures. The atmospheric pressure detecting sensor 30 generally incorporates a pressure sensing element which makes use of the piezoresistance effect of a silicon chip, and it amplifies and temperature-compensates a change in an electric current flowing through a bridge-shaped resistor formed on the chip, which change is caused by pressure distortion, and it outputs the processed change. The pressure detection tolerances present a temperature characteristic in which the tolerances are the smallest at ordinary temperatures as shown in FIG. 12. Hence, this embodiment enables the atmospheric pressure detecting sensor 30 to be operated under a condition with minimized pressure detection tolerances.

Furthermore, since the sensor mounting holder 34 is fixed above and near the upstream opening 18*a* of the throttle body 18, the atmospheric pressure detecting sensor 30 is disposed at the end portion of the intake air path in the outboard motor 2. Hence, the atmospheric pressure detecting sensor 30 lies in the air, from which water contents such as water droplets have been separated sufficiently by colliding with the engine components in the course of passing through the air intake path, thus making it possible to prevent water or the like from getting into the atmospheric pressure detecting sensor 30. In this embodiment, the detecting port 30*a* of the atmospheric pressure detecting sensor 30 is directed downward, making even harder for water to enter the atmospheric pressure detecting sensor 30. The same operations and advantages apply also to the intake air temperature detecting sensor 28. The atmospheric pressure detecting sensor 30 itself does not generate heat, and therefore, both the intake air temperature detecting sensor 28 and the atmospheric pressure detecting sensor 30 can be held by the single sensor mounting holder 34, providing the advantages over the conventional structure as described above.

The embodiment described above is one of preferred embodiments of the present invention and the technological scope of the present invention is not limited thereto. For instance, the sensor mounting holder in accordance with the present invention is not limited to the sensor mounting holder 34 according to the embodiment, and it may have other shape as long as it holds a plurality of control sensors, but it should have a shape which enables it to absorb vibrations in every direction transferred from the engine 4 and which requires less bolts, clamps, and other components.

Thus, according to the present invention, the number of components for attaching control sensors can be reduced and the assembling working and cost can be reduced accordingly. Moreover, a higher degree of freedom of laying out the parts constituting the engine can be achieved and efficient wiring can also be achieved. In addition, the vibration insulating properties for control sensors can be further improved, and the throttle body used for an engine of other equipment than the outboard motor can be used. Furthermore, control sensors can be operated in an environment of ordinary or near ordinary temperatures, thus enabling the control sensors to perform more accurate detection.

What is claimed is:

1. A structure for mounting a control means in an engine of an outboard motor which is provided with a fuel injecting unit and a plurality of control sensors including at least an intake air temperature detecting sensor and a pressure detecting sensor for controlling the fuel injecting unit, wherein a discrete sensor mounting holder, as a single holding means, for holding the plurality of control sensors is fixed to the engine, said discrete sensor mounting holder being formed of a vibration-proof member.

2. A structure for mounting a control means in an engine of an outboard motor according to claim 1 wherein the engine is further provided with a throttle means having substantially a cylindrical body and having an opening formed on an upstream side of an air flow and wherein said sensor mounting holder is fixed above the opening of the throttle means body.

3. A structure for mounting a control means in an engine of an outboard motor according to claim 2, wherein said sensor mounting holder has substantially a box-shaped outer appearance provided with a plurality of holding sections in which the plurality of control sensors are accommodated and held, respectively, and a mounting piece formed with a fastening means insertion hole.

4. A structure for mounting a control means in an engine of an outboard motor according to claim 2, wherein the vibration-proof member forming the sensor mounting holder is an elastic member such as rubber having heat insulation performance and durability.

5. A structure for mounting a control means in an engine of an outboard motor according to claim 1, wherein the engine is a multicylinder, two-stroke cycle engine equipped with a crankcase which rotatably supports a crankshaft, a surge tank which is disposed at a front portion of the crankcase and which communicates with an interior of the crankcase, and a throttle means having substantially a cylindrical body which is disposed on a right or left side of the surge tank to communicate with the surge tank and which has an upstream opening directed sideways and wherein said sensor mounting holder is located above the upstream opening of the throttle body and fixed on a side wall of the surge tank.

6. A structure for mounting a control means in an engine of an outboard motor according to claim 5, wherein said sensor mounting holder has substantially a box-shaped outer appearance provided with a plurality of holding sections in which the plurality of control sensors are accommodated and held, respectively, and a mounting piece formed with a fastening means insertion hole.

7. A structure for mounting a control means in an engine of an outboard motor according to claim 6, wherein the side wall of said surge tank is formed with a boss to which said mounting piece is attached.

8. A structure for mounting a control means in an engine of an outboard motor according to claim 5, wherein the vibration-proof member forming the sensor mounting holder is an elastic member such as rubber having heat insulation performance and durability.

* * * * *